US005652610A

United States Patent [19]

Kawai et al.

[11] Patent Number: 5,652,610

[45] Date of Patent: Jul. 29, 1997

[54] INK TANK, INK TANK-INTEGRATED HEAD CARTRIDGE HAVING THE TANK AND INK HEAD CONSTRUCTED INTEGRALLY, AND INK JET PRINTING APPARATUS HAVING THE INK TANK OR HEAD CARTRIDGE

[75] Inventors: Jun Kawai, Tokyo; Yohei Sato; Yoichi Taneya, both of Yokohama; Hiroshi Sugitani, Machida; Tokuya Ohta, Yokohama; Kazuaki Masuda, Kawasaki; Hiroyuki Ishinaga, Tokyo; Torachika Osada, Yamato; Masahiko Higuma, Togane; Takashi Saito, Yokohama, all of Japan

[73] Assignee: Canon Kabushiki Kaisha, Tokyo, Japan

[21] Appl. No.: 241,597

[22] Filed: May 12, 1994

[30] Foreign Application Priority Data

May 13, 1993 [JP] Japan ..... 5-111939

[51] Int. Cl.[6] ..... B41J 2/175

[52] U.S. Cl. ..... 347/87; 347/7

[58] Field of Search ..... 347/7, 87, 86, 347/92, 93, 85

[56] References Cited

U.S. PATENT DOCUMENTS

| | | | |
|---|---|---|---|
| 4,524,365 | 6/1985 | Kakeno et al. | 346/75 |
| 4,631,548 | 12/1986 | Milbrandt | 346/1.1 |
| 4,929,969 | 5/1990 | Morris | 346/140 R |
| 4,935,751 | 6/1990 | Hamlin | 347/86 |
| 5,079,570 | 1/1992 | Mohr et al. | 346/140 R |
| 5,132,711 | 7/1992 | Shinada et al. | 347/6 |
| 5,162,817 | 11/1992 | Tajika et al. | 347/7 |
| 5,162,818 | 11/1992 | Karita et al. | 347/86 |
| 5,241,189 | 8/1993 | Vandagriff et al. | 347/7 |
| 5,371,529 | 12/1994 | Eguchi et al. | 347/7 |

FOREIGN PATENT DOCUMENTS

| | | |
|---|---|---|
| 0443245 | 8/1991 | European Pat. Off. . |
| 60-097858 | 5/1985 | Japan . |
| 61-222785 | 10/1986 | Japan . |
| WO9102652 | 3/1991 | WIPO . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

An ink absorbing member is inserted in an ink tank housing which at least partly has a transparent portion. Used as this ink absorbing member is one having a reflection density after ink removal which is close to the reflection density of a melamine foam before ink injection. The amount of ink remaining in a cartridge of such a construction can be detected, for example, by a separate line sensor. The results of detection by the line sensor can be displayed by a remaining ink amount indicator provided on a control panel of the printing apparatus.

23 Claims, 9 Drawing Sheets

INK TANK, INK TANK-INTEGRATED HEAD CARTRIDGE HAVING THE TANK AND INK HEAD CONSTRUCTED INTEGRALLY, AND INK JET PRINTING APPARATUS HAVING THE INK TANK OR HEAD CARTRIDGE

BACKGROUND OF THE INVENTION

1. Field of the Invention

The present invention relates to an ink tank, an ink tank-integrated head cartridge constructed of the ink tank and an ink head integrated with the ink tank, and an ink jet printing apparatus having the ink tank or the head cartridge, and more particularly, to an improved construction with an absorbing member for holding ink provided in the ink tank. Here, printing refers to processes involving the imparting of ink to any of ink supports to be inked, such as cloth, yarn or sheet materials. The present invention can be used for all information processing devices, or instruments including printers as their output devices.

2. Description of the Related Art

Of print heads of the ink jet type, a print head is known to have heating elements and eject a printing liquid such as ink (hereinafter referred to as ink) by utilizing thermal energy generated by the heating elements. In the print head, the heating elements or ink orifices can be miniaturized. Thus, the use of a print head of this type permits the printing of highly accurate images. This type of ejection also enables relatively high speed and low noise printing.

In addition to the above-described advantages, this type of print head can be produced by the same film forming step as for a semiconductor device, so that its price can be rendered relatively low. Hence, a proposal has been made of a head cartridge constructed of such a print head and an ink tank integrated with the print head and being attachable to and detachable from the apparatus. With such a construction, it becomes possible to replace the ink tank together with the print head by a new head cartridge when the ink in the ink tank has been used up.

In such a head cartridge, fresh ink in an amount corresponding to the amount of ink consumed by the print head needs to be fed to the print head through a feed port from a liquid reservoir serving as an ink tank for holding ink. Furthermore, when ink need not be fed because no printing is done, ink is required not to leak from the feed port to the outside of the reservoir.

Such a requirement is important for the above reservoir used in the ink jet system of the kind performing printing by ejecting ink from the print head, particularly in consideration of the possible influence of the feed amount of ink on image quality. As ink tanks fulfilling that requirement, the forms described below have been heretofore known.

FIG. 1 is a sectional view illustrating the internal structure of an ink tank in a head cartridge for use in a conventional ink jet printing apparatus. In FIG. 1, the reference numeral 311 denotes a cartridge body. The cartridge body 311 has in its inside an ink tank, which houses almost throughout it an absorbing member 312 for holding ink. In a side wall of the cartridge body 311 is provided an ink supply port 313 for making the inside of the ink tank communicating with a print head (not shown). In another side wall of the cartridge body 311 is formed an air communicating port which enables communication between the inside of the cartridge body 311 and the atmosphere. In FIG. 1, the symbol a represents that portion of the absorbing member 312 which holds ink, and the symbol b represents that portion of the absorbing member 312 which does not hold ink.

With the cartridge of the above construction, negative pressure within the ink reservoir is controlled by the capillary force of the absorbing member 312, and thus causes no ink leakage to the outside.

The use, say, of a urethane foam as a constituent of the absorbing member 312, however, poses the following two problems, making it practically impossible to detect the amount of ink remaining in the cartridge with the naked eye or by an optical means:

First, the change in the reflection density of the absorbing member 312 depending on the presence or absence of ink in the absorbing member is small, thus making the boundary between the portion a and the portion b in FIG. 1 not clearly visible.

Secondly, the long-term storage of the cartridge results in the yellowing of the absorbing member 312 itself, causing a marked change in its reflection density. In the case of yellow ink, in particular, the difference between the density before and after consumption of ink is 0.1, making it virtually impossible to optically detect the amount of ink that has remained.

A known example of a remaining ink amount detection means in an ink tank using such an absorbing member is that of the construction described in U.S. Pat. No. 5,079,570.

FIGS. 2A and 2B are sectional views showing the construction of a head cartridge having a remaining ink amount detection means disclosed in this patent. FIG. 2A shows the absorbing member filled up with ink, and FIG. 2B shows the consumption of ink proceeding. In FIGS. 2A and 2B, the numeral 210 denotes a head cartridge using an absorbing member. The cartridge 210 is composed of a housing 212, an absorbing ink reservoir 214 for storing a large amount of ink therein, a C-letter shaped transparent tube 220 for detection of an ink level, and a print head 216. The C-letter shaped transparent tube 220 is composed of a transparent central tubular portion **220*a* which is disposed so as to extend in a vertical direction (gravitational direction) when the head cartridge 210 is placed in the same posture as during use and which indicates the position of the ink level to the outside; and an upper tubular portion 220*b* and a lower tubular portion 220*c* which are connected to the ends of the central tubular portion 220*a* and supply ink to the tubular portion 220*a***.

In the cartridge of the above construction, however, when the level of ink held in the absorbing member within the housing 212 lowers to below the upper tubular portion **220*b* as shown in FIG. 2B as a result of increasing consumption of ink, ink within the central tubular portion 220*a* and the lower tubular portion 220*c* is absorbed to the absorbing member side under the capillary action of the absorbing member. Consequently, all the ink in the C-letter shaped transparent tube 220 is exhausted, indicating no ink remaining. That is, the C-letter shaped transparent tube 220** indicates ink exhaustion, although there is a considerable amount of ink held in the portion a of the absorbing member.

The cartridge of the above construction also requires a step of attaching the C-letter shaped transparent tube 220 to the housing 212, thus adding to costs.

Furthermore, if there is a member for supplying ink held in the absorbing member to the print head 216 upon contact with the absorbing member at a point near the ink outlet inside the housing 212 corresponding to the position of the print head 216, this contact may bring about the deterioration of the absorbing member over time, forming voids there and exerting adverse influences from the dwelling of air. In the worst case, communication between the air communicating port 217 and the voids near the ink outlet may emerge. This may make the desired ejection impossible, and cause ink existent in the ink supply passage to drool from the ink ejection orifice, thereby staining the inside of the apparatus, etc.

In addition, ink supply from the absorbing member to the ink outlet relies on the action of gravity, and so may fail to accompany the driving of the print head, etc. at a high frequency which has recently been desired. In order to enhance the accompanying characteristic of ink supply, it is conceivable to give a certain large bore diameter to the ink orifice of the print head, thereby lowering the resistance of flow through the ink supply passage leading to the ink orifice. In this case, the ink retaining capacity of the absorbing member may lower, and ink leakage from the air communicating port may occur.

U.S. Pat. No. 4,929,969 describes in column 7, lines 52–57 that compression may be desired in particular applications to adjust structural interstitial spaces, while maintaining the useful or preferred characteristics in an incompressed state.

SUMMARY OF THE INVENTION

Such a description may be made with particular emphasis on a good balance between the internal dimensions of the storage space and the external dimensions of the absorbing member. The present inventors have found, however, that the use of the absorbing member in an appropriately compressed state is recommendable to perform ink supply smoothly and reliably without relying on the posture or the like of the ink tank, while utilizing the advantage of the absorbing member composed of a thermoset melamine condensate. The present inventors have also found technical problems, i.e. that the absorbing member should be compressed in an appropriate direction in order to supply ink smoothly in accordance with the structure of the absorbing member; that the absorbing member can undergo "permanent set in fatigue" or destruction in the compressed portion, because the fibrous structure is relatively brittle; and that once this permanent set occurs, the compressed state cannot be maintained, producing a similar state to an incompressed state, posing the above-described problems.

The object of the present invention is to resolve the above-noted problems, and to provide an ink tank, a head cartridge, and an ink jet printing apparatus which enable the amount of remaining ink to be detected inexpensively and accurately, The object of the present invention is to provide an ink tank including a housing at least partly having a transparent portion, and an ink absorbing member accommodated in the housing, the ink absorbing member being such that a difference between its reflection density before ink consumption and its reflection density after ink consumption is 0.1 or more in terms of absorbance (O.D.).

Here, the ink absorbing member may be a porous material having a three-dimensional network and is also a thermosetting foam based on a condensate of an amino-containing compound with formaldehyde. The amino-containing compound may be at least one compound selected from the group consisting of melamine, urea, carboxylic acid amides, dicyandiamide, guanidine, sulfuryl amide, sulfonic acid amides, aliphatic amines, and derivatives thereof.

Also, the ink absorbing member may be a porous ceramic material or metal fibers combined.

Another object of the present invention is to provide a head cartridge constructed of an ink tank and an ink head integrated with the ink tank and being attachable to and detachable from an ink jet printing apparatus, the ink tank including a housing at least partly having a transparent portion, and an ink absorbing member accommodated in the housing, said ink absorbing member being such that a difference between its reflection density before ink consumption and its reflection density after ink consumption is 0.1 or more in terms of absorbance (O.D.), and the ink head being adapted to eject ink to a printing medium.

Here, the ink tank and the ink head may be separable from each other.

The ink head may have an electro-thermal converter, which generates thermal energy for causing film boiling to ink, as an element for generating energy for use in ejecting ink.

Further another object of the present invention is to provide an ink jet printing apparatus including: an ink tank including a housing at least partly having a transparent portion, and an ink absorbing member accommodated in the housing, the ink absorbing member being such that a difference between its reflection density before ink consumption and its reflection density after ink consumption is 0.1 or more in terms of absorbance (O.D.), remaining ink amount detection means for detecting the amount of ink remaining within the ink absorbing member through the transparent portion of the housing of the ink tank, and means of presenting information corresponding to data on the amount of remaining ink provided by the remaining ink amount detection means.

Another object of the present invention is to provide an ink jet printing apparatus including: a head cartridge constructed of an ink tank and an ink head integrated with the ink tank and being attachable to and detachable from the ink jet printing apparatus, the ink tank including a housing at least partly having a transparent portion, and an ink absorbing member accommodated in the housing, the ink absorbing member being such that a difference between its reflection density before ink consumption and its reflection density after ink consumption is 0.1 or more in terms of absorbance (O.D.), and the ink head being adapted to eject ink to a printing medium; remaining ink amount detection means for detecting the amount of ink remaining within the ink absorbing member through the transparent portion of the housing of the ink tank; and means of presenting information corresponding to data on the amount of remaining ink provided by the remaining ink amount detection means.

Here, the remaining ink amount detection means may be optical means for measuring the absorbance of ink.

Also, the transparent portion of the ink tank may be formed along a direction which becomes the direction of gravity during the use of the ink tank, and the optical remaining ink detection means is a line sensor which detects the amount of remaining ink through all of the transparent portion of the ink tank.

The optical remaining ink detection means may be a spot sensor which detects the amount of remaining ink through part of the transparent portion of the ink tank.

At least part of an ink supply portion extending from the ink tank to the ink head may be formed to be transparent, and the optical remaining ink detection means is a spot sensor which detects the amount of remaining ink through the transparent portion of the ink supply portion.

The optical remaining ink detection means may detect the amount of remaining ink over time, and the information presentation means displays the amount of remaining ink in response to data on the amount of remaining ink detected over time by the optical remaining ink detection means.

The information presentation means may display the exhaustion of ink in response to data on the amount of remaining ink detected by the optical remaining ink detection means.

The optical remaining ink detection means may be equipped with a color filter corresponding to the color of ink within the ink tank.

Another object of the present invention is to provide an ink jet printing apparatus including an absorbing member holding ink, means for optically detecting over time the amount of ink remaining in the absorbing member, and means for varying the ink ejection conditions in response to changes in the characteristics of the ink absorbing member caused in accordance with data on the amount of remaining ink detected over time by the optical remaining ink detection means.

Here, the ejection conditions may be the head driving conditions such as voltage or pulse duration. The ejection conditions may use an insulating heater. The ejection conditions may be varied by inclining the ink tank.

The above and other objects, effects, features and advantages of the present invention will become more apparent form the following description of embodiments thereof taken in conjunction with the accompanying drawings.

BRIEF DESCRIPTION OF THE DRAWINGS

FIGS. 2A and 2B are each a schematic sectional view showing the internal structure of a head cartridge having a conventional remaining ink amount detection means, in which FIG. 2A illustrates the state of ink filled into the entire absorbing member within the ink tank of the head cartridge, while FIG. 2B illustrates the state of ink being consumed increasingly;

FIGS. 4A, 4B, 4C and 4D show an embodiment of the head cartridge according to the present invention, in which FIG. 4A is a schematic sectional view showing the internal structure of the head cartridge with ink consumption relatively not yet proceeding, FIG. 4B is a graph illustrating the results of detection of the amount of ink remaining in the state shown in FIG. 4A, FIG. 4C is a schematic sectional view showing the internal structure of the head cartridge with ink consumption proceeding from the state shown in FIG. 4A, and FIG. 4D is a graph illustrating the results of detection of the amount of ink remaining in the state shown in FIG. 4C;

DETAILED DESCRIPTION OF THE PREFERRED EMBODIMENTS

Preferred embodiments of the invention will now be described in detail with reference to the drawings.

<Embodiment 1>

Figure 1:
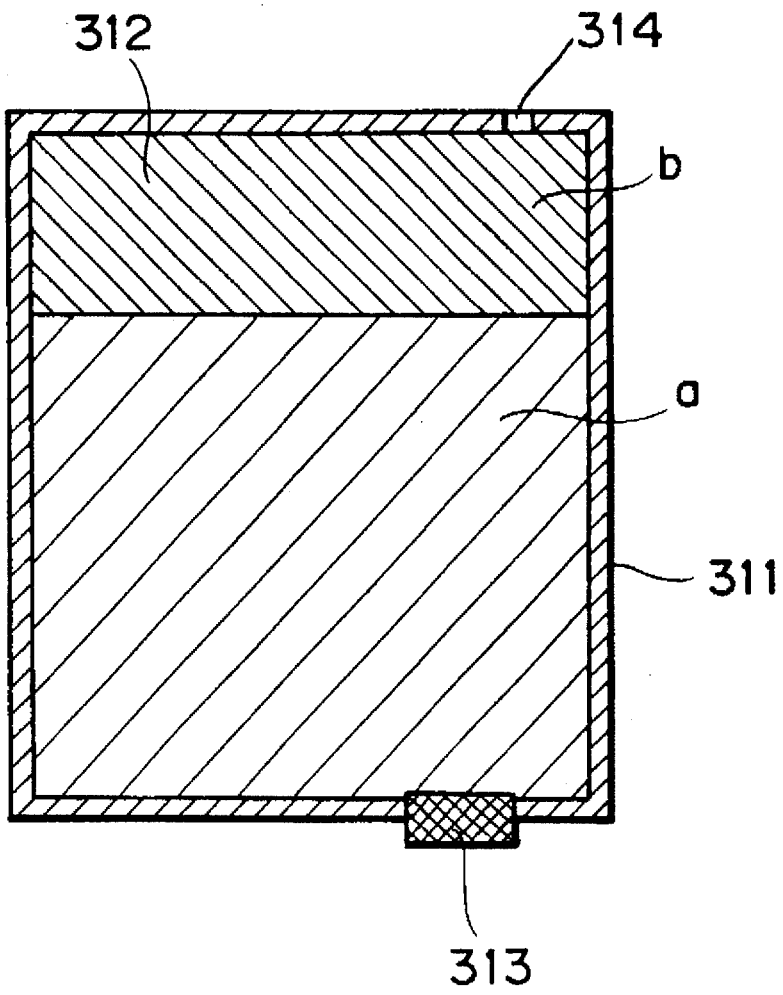
FIG. 1 (PRIOR ART)
FIG. 1 is a schematic sectional view showing the internal structure of an ink tank of a head cartridge used in a conventional ink jet printing apparatus.
Figure 2A:
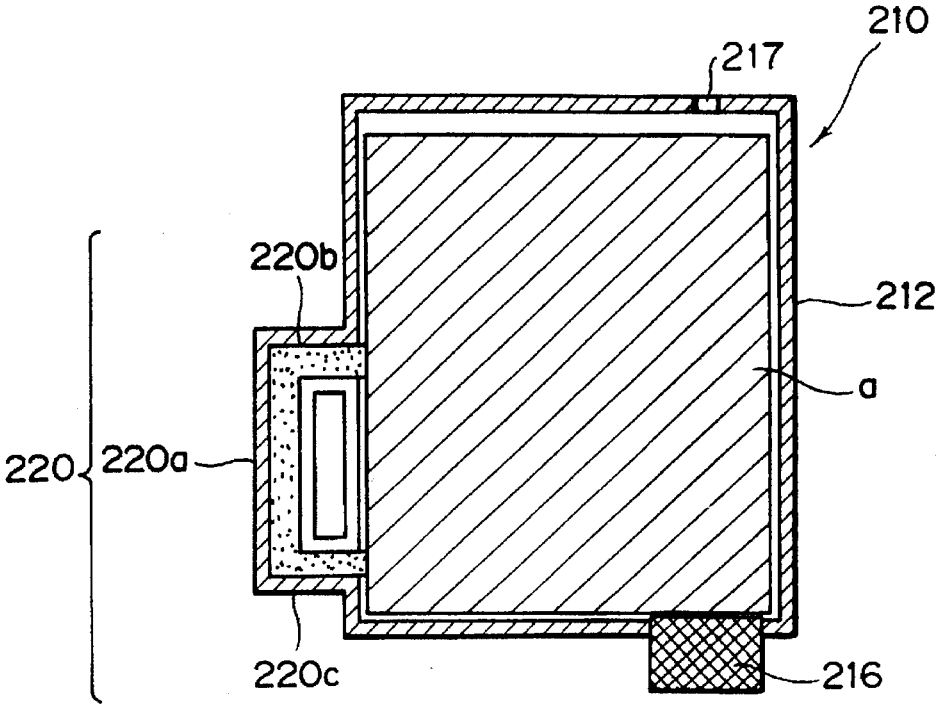
FIG.2A (PRIOR ART)
Figure 2B:
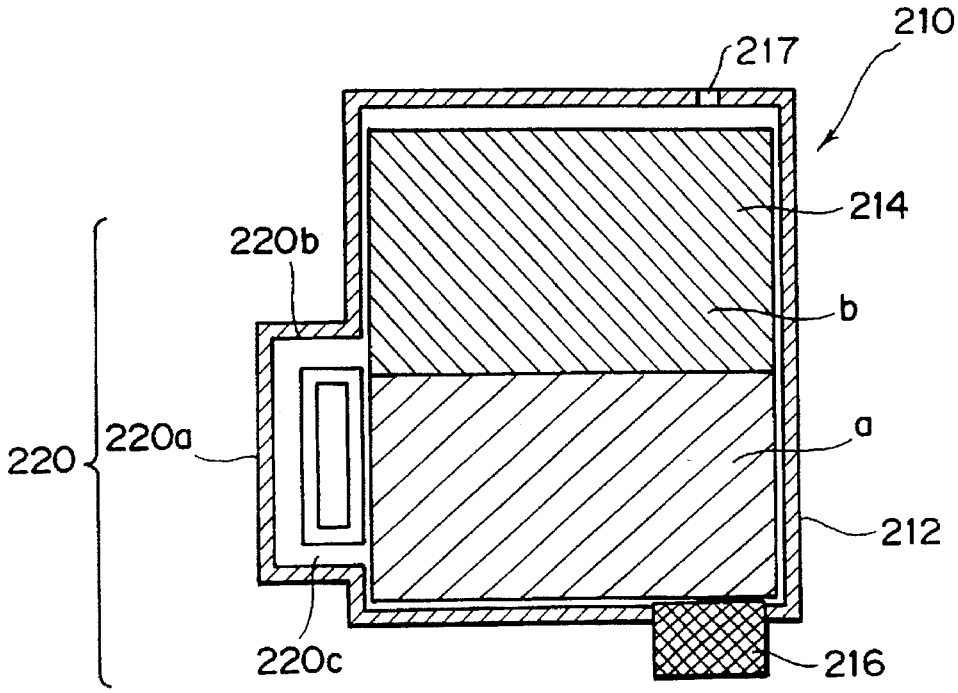
FIG.2B (PRIOR ART)
Figure 3:
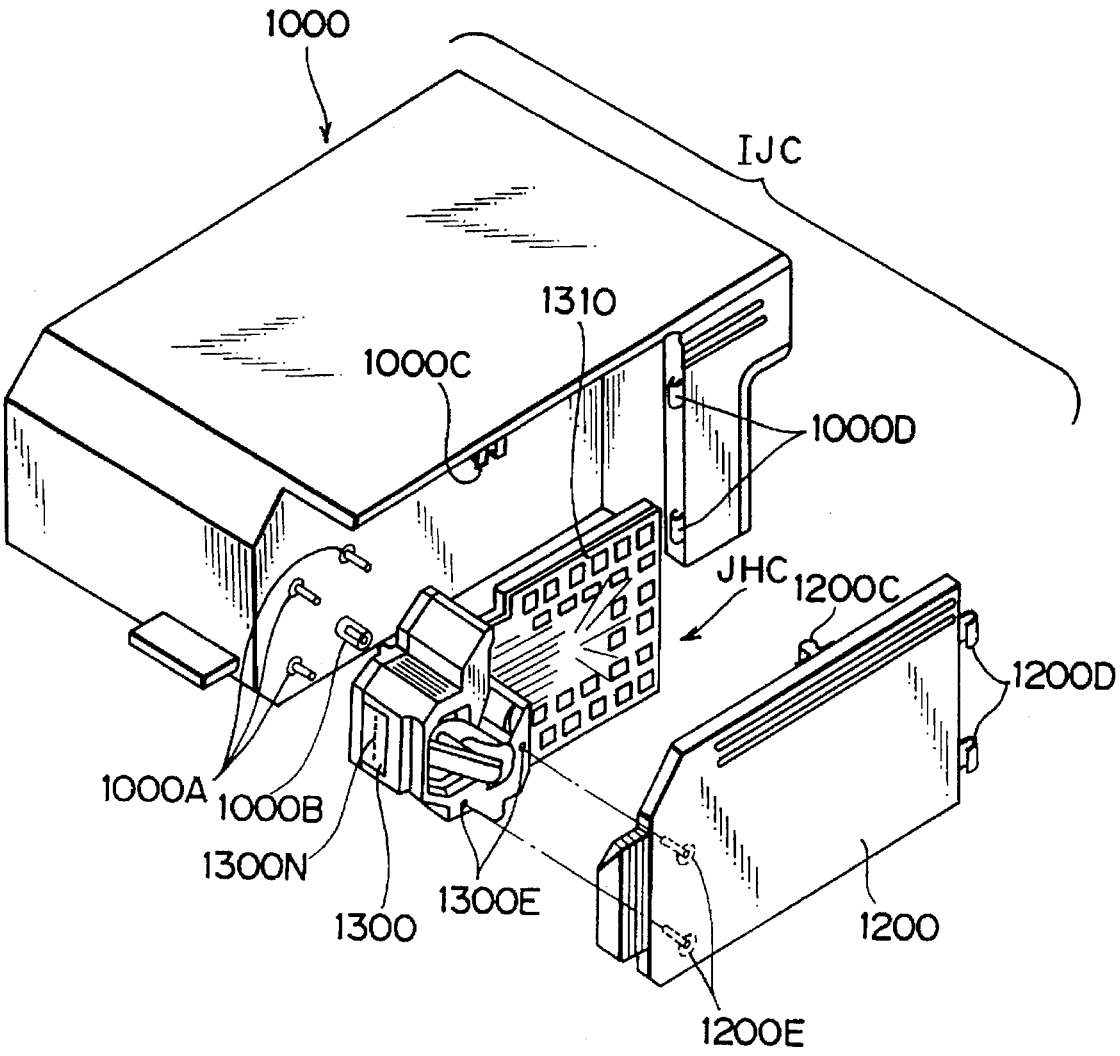
FIG. 3 is an exploded perspective view showing an embodiment of a head cartridge according to the present invention.

FIG. 3 is an exploded perspective view of an embodiment of a head cartridge according to the present invention, with a print head chip and an ink tank being in a separate state.

As shown in FIG. 3, a head cartridge IJC comprises an ink tank 1000 and a print head chip JHC, which are attachable to and detachable from each other.

The ink tank 1000 has in its inside a structure for storing ink and a structure for supplying the stored ink to a print head in a satisfactory way, as will be described later. The print head chip JHC comprises a print head 1300 and a substrate 1310. The print head 1300 is formed by forming an electro-thermal converting element from a heat generating resistor or the like at a tip portion of the substrate 1310, and laminating thereon a top plate for constructing ejection orifices 1300N, a liquid passage, and so on. FIG. 3 shows a cover for covering the print head 1300, but does not show the electro-thermal converting element, top plate, etc. in an area of the substrate 1310 other than the area where the print head is formed, are formed an electrode wiring and a drive circuit for driving the electro-thermal converting element.

Next, a structure for attaching and detaching the print head chip JMC and the ink tank 1000 to and from each other, and a structure for holding them together will be described.

The print head chip JHC has holes (not shown) provided on the back side of the substrate 1310 in FIG. 3 for fitting thereinto three pins 1000A and an ink supply tube 1000B that are provided on a side surface of the ink tank 1000. Of these holes, the hole for fitting the ink supply tube into it is, needless to say, a hole for guiding ink into a common liquid chamber of the print head. Because of this structure, the print head chip JHC, during its mounting on the ink tank 1000, is mounted while being brought to a predetermined position. The print head chip JHC thus mounted on the ink tank 1000 is held in place by a closure 1200 constituting a part of the head cartridge IJC. That is, the closure 1200 has on an end thereof two hinge members 1200D, which are engaged with two corresponding hinge members 1000D provided on the ink tank 1000, whereby the closure 1200 is mounted on the ink tank 1000 so as to be openable and closable with that portion of engagement as the axis. The closure 1200 also has two pins 1200E near to the other end thereof, and these pins are fitted into two holes 1300E provided on the cover of the print head in accordance with the above-mentioned closing action of the closure 1200. Also attendant on this closing action, snap members 1200C provided on both side portions of the closure 1200 (only one of the snap members is shown in FIG. 3) are engaged tightly, because of their elasticity, with corresponding snap-fit members provided on the ink tank. Thereby is the print head chip JHC fixed to the ink tank 1000, and the closure 1200 is fixed to the ink tank 1000 at the same time.

Figure 4B:
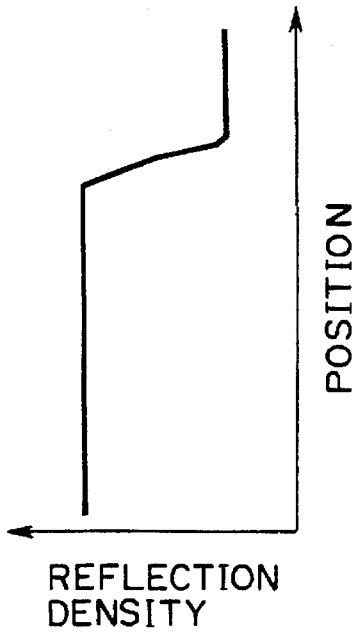
Figure 4A:
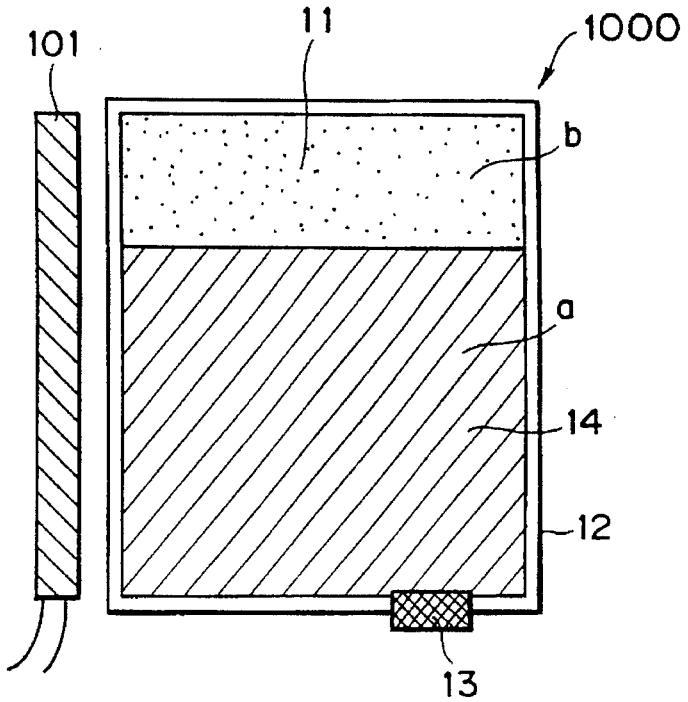
Figure 4D:
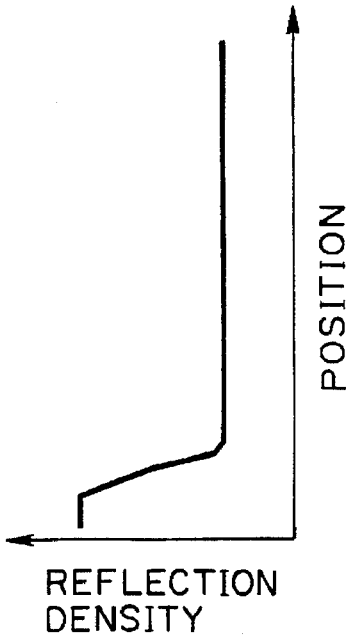
Figure 4C:
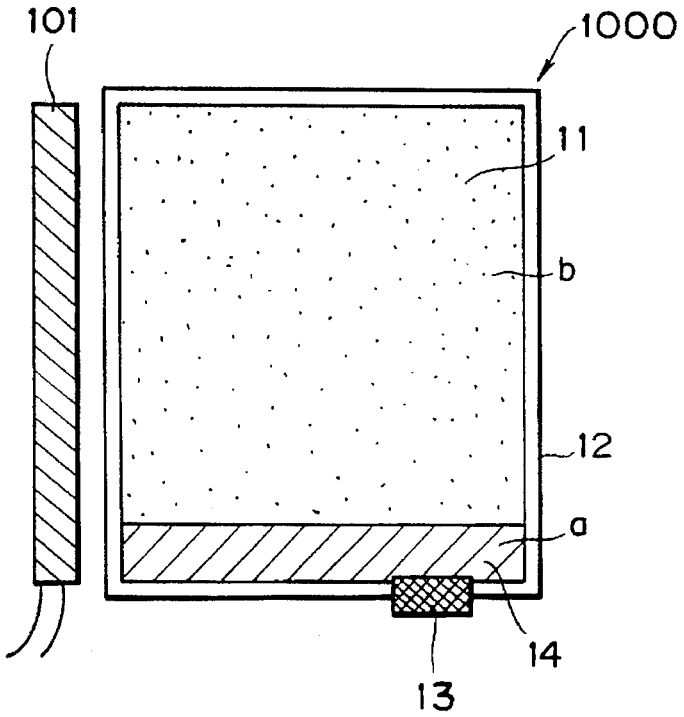

FIGS. 4A, 4B, 4C and 4D are each a schematic sectional view of the ink tank of the head cartridge shown in FIG. 3. FIG. 4A is a sectional view showing the inside of the head cartridge with ink consumption relatively not yet proceeding. FIG. 4B is a graph illustrating the results of detection of the amount of ink remaining in the state shown in FIG. 4A. FIG. 4C is a sectional view showing the inside of the head cartridge with ink consumption proceeding from the state shown in FIG. 4A. FIG. 4D is a graph illustrating the results of detection of the amount of ink remaining in the state shown in FIG. 4C.

Figure 5:
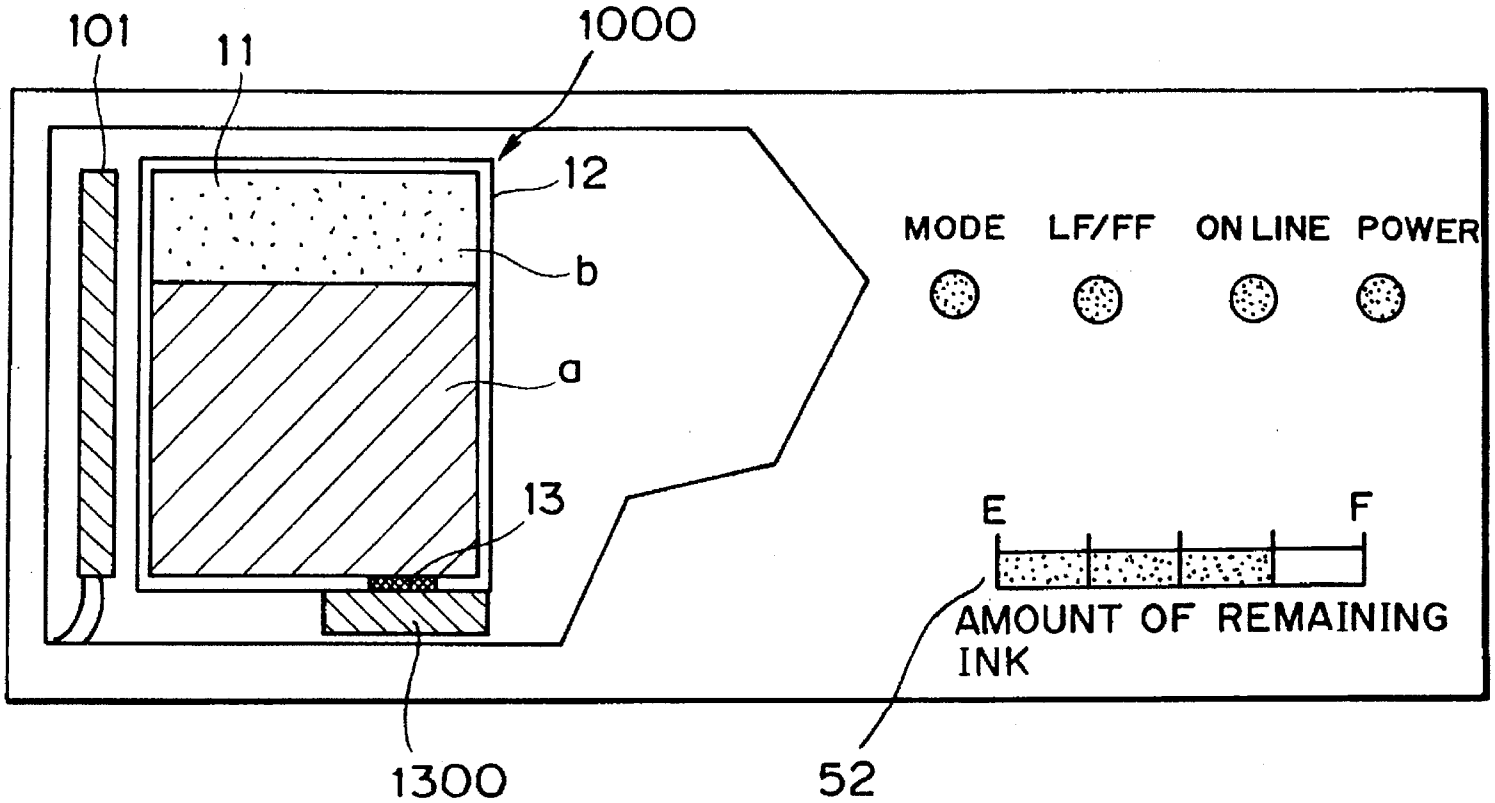
FIG. 5 is a schematic front view, partly broken away, of an embodiment of an ink jet printing apparatus according to the present invention incorporating the head cartridge depicted in FIGS. 4A through 4D.

FIG. 5 is a schematic front view, partly broken away, of an embodiment of an ink jet printing apparatus according to the present invention mounting the had cartridge equipped the ink tank with the head chip depicted in FIGS. 4A through 4D.

The construction of the ink tank of the head cartridge will be described with reference to FIGS. 4A through 4C. An ink tank 1000 of the head cartridge IJC is generally composed of an ink absorbing member 11 and an ink tank housing (hereinafter referred to as the housing) 12 accommodating the ink absorbing member 11. An air communicating port, which is not shown in the following drawings, is arranged at the housing 12. The material constituting the ink absorbing member 11 in this embodiment is a melamine foam, for example, BASOTECT® manufactured by BASF Aktiengesellschaft, Federal Republic of Germany. The ink absorbing member 11 made of the melamine foam has excellent ink discharge characteristics, and its reflection density after ink removal is close to the reflection density of the melamine foam before ink injection. The housing 12 in the instant embodiment is formed entirely of a transparent material so that the characteristics, such as ink discharge characteristics, of the ink absorbing member 11 can be utilized and the amount of remaining ink can be observed or detected from the outside. At a lower wall portion of The housing 12 is provided an ink Supply portion 13 for feeding ink to the print head 1300. The housing 12 and the print head 1300 are integrated, say, detachably via the ink supply portion 13, thereby constructing an embodiment of the integral head cartridge according to the present invention. In the instant embodiment, black ink containing 3.0% of a dye is used as ink 14.

The detection of the amount of ink remaining in the cartridge of the above-described construction can be performed, for example, by means of a separate line sensor 101. The line sensor 101 as a remaining ink amount detection means is disposed in the vicinity of the housing 12, and detects the amount of ink remaining in the housing 12 by measuring the reflection density of the absorbing member at the position of each of a plurality of individual sensors. The results of detection by the line sensor 101 can be displayed, for example, by a remaining ink amount indicator 52 provided on a control panel 51 of the printing apparatus shown in FIG. 5. That is, ink is filled into the ink tank provided with the ink absorbing member 11, and ink drops are ejected from the print head 1300 via the ink supply port 13 located at a lower portion of the ink tank. Ink is thus consumed successively. Simultaneously, a constant voltage is applied to the line sensor 101 fixed 5 mm apart from the tank housing 12 parallelly to the direction of gravity, whereby an output of the intensity of reflected light from the absorbing member is obtained as a current volume. This output is passed through an A-D converter circuit (not shown), and LED displayed by the remaining ink amount indicator 52 on the control panel 51 Shown in FIG. 5.

As depicted in FIGS. 4B and 4D, the amount of ink remaining in the ink tank can also be accurately determined by measuring the reflection density of the absorbing member. Specifically, the intensity of reflected light increases sequentially, beginning at that element in the line sensor 101 which is opposite to the b portion where ink has been removed. This intensity can be expressed concretely as a reflection density as determined by the Macbeth reflection densitometer RD-918. The reflection density of the ink absorbing member full of ink (a portion) is found, to be 1.7±0.1, while the reflection density of the ink absorbing member after consumption of ink comes to be 0.9±0.1. This means that if the reflection density in the range of from 1.0 to 1.6 is set to be the threshold, the amount of ink present in the ink tank can be always detected. This is because the melamine foam used in the instant embodiment has excellent ink discharge characteristics, and its reflection density after ink removal is close to the reflection density of the melamine foam before ink injection. Such measurements performed over time can give knowledge the consumption of ink at the time of measurement.

The remaining ink amount indicator 52 gives displays of the amount of remaining ink on a scale of 4 grades, but can show the amount in more grades without being restricted to the 4-grade scale.

As a control, the reflection density of a urethane foam that has been heretofore used was measured. The reflection density of the a portion of the ink absorbing member 312 filled up with ink was 1.7±0.1, while that of the b portion of the ink absorbing member 312 after ink consumption was 1.6±0.1, indicating a change in reflection density of about 0.1. However, there were variations in this change, and some urethane foams underwent little change. Thus, urethane foam can be found unusable in the present invention.

In addition, melamine foams even when stored for long periods deteriorated minimally, and showed little change in reflection density due to yellowing.

Consequently, in the present invention, even if ink was consumed for a long period of time, the amount of ink was detectable faithfully from the time when the housing was filled up with ink until the time when ink was used up while keeping the threshold of the line sensor 101 set at the initial value.

In the meantime, it was observed that the ink discharge characteristics of the melamine foam vary in response to the amount of remaining ink detected by the above-described method. For example, the melamine foam is more highly hydrophilic than urethane foam which has been conventionally used, and has a high ink retaining force so that negative pressure is considerably increased due to the change of the amount of remaining ink. The increase of negative pressure cannot be disregarded as a condition of providing a high quality print. The above condition had not been recognized as a significant problem when the urethane foam was user. The problem had never been specifically recognized before the ink tank using the melamine foam of the present invention was made in order to solve the above problem, it is necessary to optimize the conditions of ink ejection from the print head by using at least one or any combination of the driving condition of the above print head, the use of an insulating heater, and optimization of the head pressure of the ink tank.

Optimization of the conditions of ink ejection from the print head will be set forth in detail by way of specific examples.

The ink ejection conditions were optimized by varying driving conditions as set forth below in accordance with highly accurate, highly responsive remaining ink amount detection information of the present embodiment. More specifically, as the amount of remaining ink decreases, negative pressure on the ink absorbing member side increases. Consequently, if driving pulses of a fixed shape are constantly applied, the ink amount of ejection decreases, causing print concentration to lower.

In the meantime, the ink amount of ejection was kept constant by successively lengthening the width of a driving pulse in response to the amount of remaining ink. That is, the present invention enables the amount of remaining ink to be detected as an analog pattern, so that the ejection conditions can be always optimized, and high quality prints can be stably provided.

The above-mentioned method can produce secondary effects. That is, the ink amount which can be used increases remarkably for the following reason.

As has been already referred, the melamine foam highly hydrophilic, and has a high ink retaining force. Consequently, it is advantageous in that it is possible to set an increased amount of ink to initially fill up the housing in comparison with urethane foam which is conventionally used. In the meantime, it is defective if that negative pressure increases with ink consumption as set forth earlier, and under such condition, an ink ejection failure will occur before the ink is used up. In view of this problem, the above-mentioned driving conditions are set to thereby maintain ejection of ink stably until ink is used up, thus overcoming the above-mentioned defect. The present invention can contribute to improvements on the amount of ink to initially fill up the housing as well as the using up of ink. As a result, it is possible to remarkably increase an amount of ink which can be used.

Additionally, in order to provide a high quality print, driving conditions in response to an amount remaining ink can be set in accordance with the following steps.

In order to obtain a high quality print, after a short pulse (a pre-pulse) which is not directly involved with ejection is applied in advance, a driving pulse (a main pulse) for ejection is applied. When such shape of the driving pulse is used, steps 1) and 2) stated below are carried out instead of successively lengthening a pulse width (corresponding to a pulse width of a main pulse).

1) To lengthen a pulse width of a pre-pulse successively; and
2) To provide a short interval starting at the time application of a pre-pulse is terminated, and ending at the time application of a main pulse begins; and to lengthening the above pulse interval successively.

The ink amount of ejection can be maintained stably by carrying out the steps stated above. Such, steps are more suitable than the change of a main pulse width.

The above explanations which have been given with respect to setting of driving and ejecting conditions also apply to another embodiments of the present invention. Consequently, the similar explanations will be omitted with respect to another embodiments.

<Embodiment 2>

Figure 6:
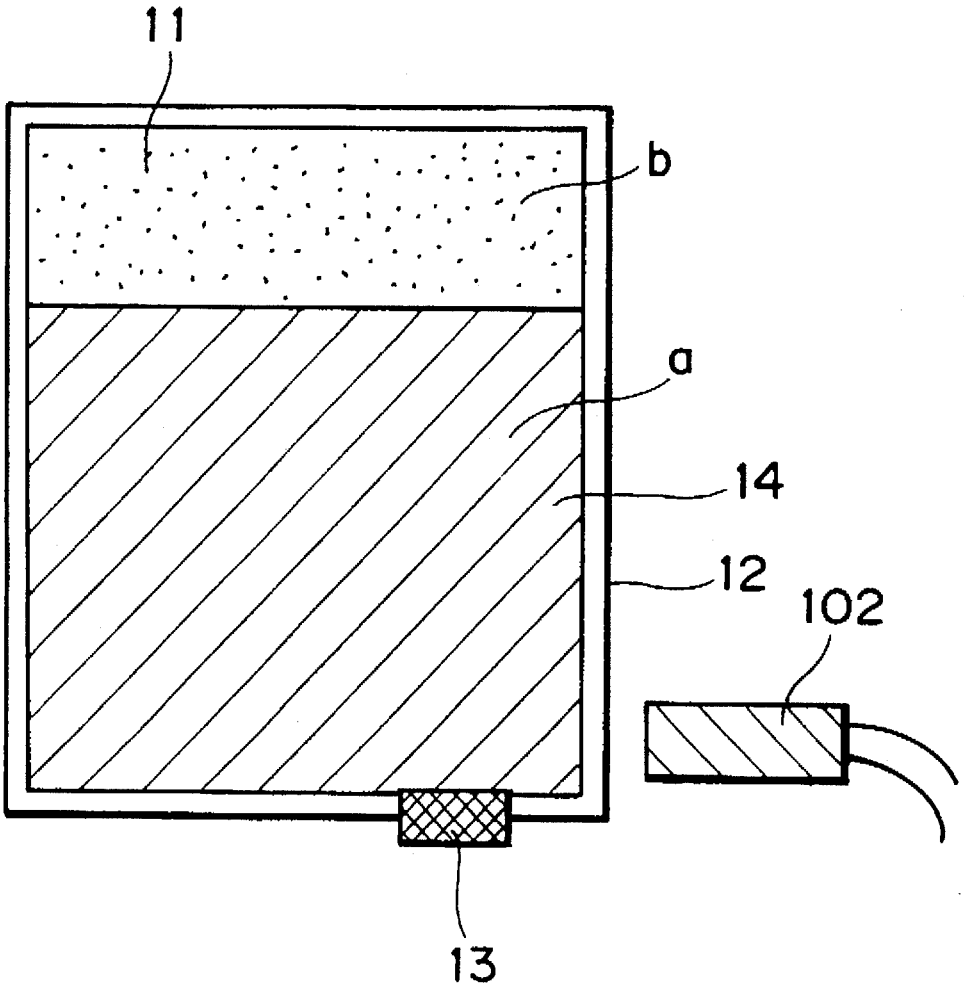
FIG. 6 is a schematic sectional view showing another embodiment of the head cartridge of the present invention.

FIG. 6 is a sectional view showing another embodiment of the ink tank of the cartridge of the present invention. This embodiment is of the same construction as that of Embodiment 1, except that the line sensor 101 is replaced by a spot sensor 102, and that the spot sensor 102 is fixed near an ink support: port 13 at a lower portion of the tank 5 mm apart from the wall of the tank housing 12.

An inexpensive printing apparatus, in particular, may have a construction in which the above inexpensive spot sensor is provided to detect only ink exhaustion and to light or have a warning lamp flicker. In this case, the reflection density varies before the exhaustion of ink, and ink exhaustion can be detected faithfully.

<Embodiment 3>

Figure 7A:
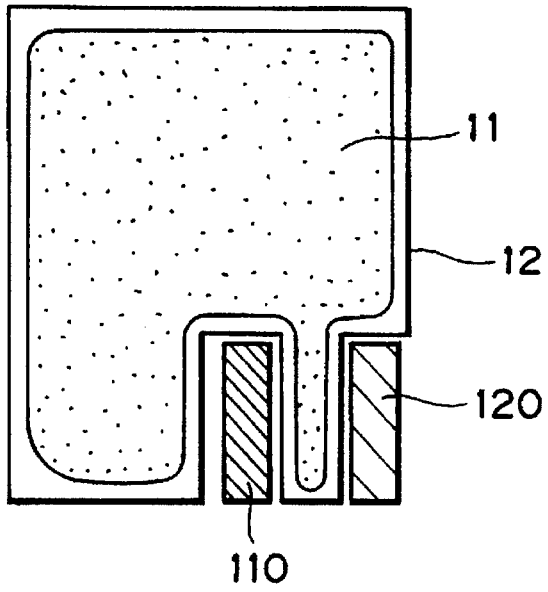
FIGS. 7A and 7B show still another embodiment of the head cartridge of the present invention, FIG. 7A being a transverse sectional view, and FIG. 7B a longitudinal sectional view.
Figure 7B:
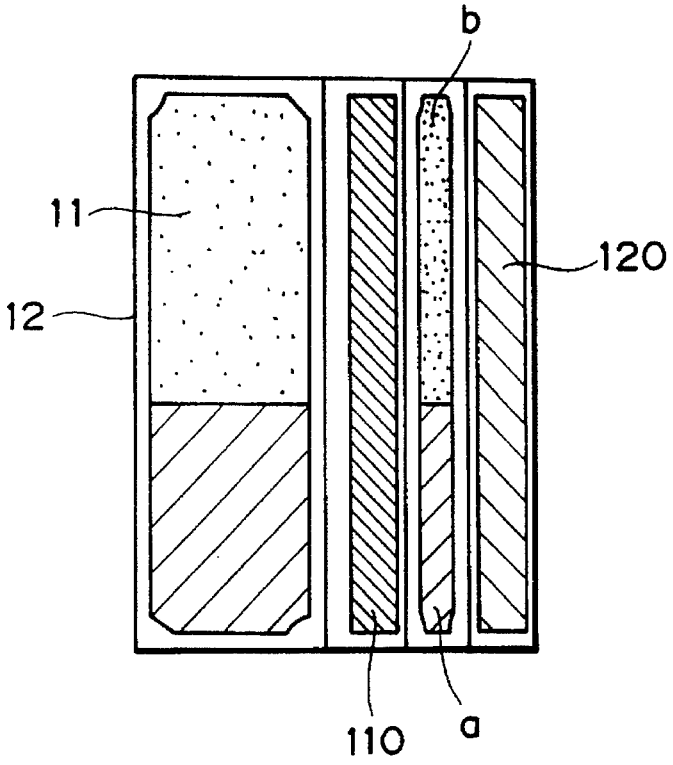

FIGS. 7A and 7B are sectional views showing still another embodiment of the ink tank of the cartridge of the present invention. FIG. 7A is a transverse sectional view of the ink tank and FIG. 7B is a longitudinal sectional view thereof. This embodiment is constructed in the same manner as in Embodiment 1, except that the reflection type line sensor 101 is replaced by one of a transmission type in which light is emitted by an LED 110 and the intensity of transmitted light is detected by a light receiving element 120 to give outputs.

In the present embodiment as well, as ink is consumed, the amount of ink is detectable faithfully from the filling-up of the tank until the exhaustion of ink, as in Embodiment 1.

In each of the foregoing embodiments, a melamine foam was used as ink absorbing member 11. However, porous materials having a three-dimensional network and being thermosetting foams based on condensates of amino-containing compounds with formaldehyde, including melamine foams, can be used preferably. Examples of the amino-containing compounds are at least one compound selected from the group consisting of melamine, urea, carboxylic acid amides, dicyandiamide, guanidine, sulfuryl amide, sulfonic acid amides, aliphatic amines, and derivatives thereof. Porous ceramic materials or metal fibers combined are also usable as the ink absorbing member 11.

In each of the embodiments, tank housing 12 made of a transparent polyethylene material was used, but the invention is in no way limited thereto. There may be used transparent resins such as polypropylene or polycarbonate, or various other materials with a high transparency, such as glass. It goes without saying that there is no need to impart transparency to the whole of the tank housing 12 as in each of the embodiments. There may be used a construction having at least part of it, say, only a side wall thereof, formed to be transparent, or a construction having the wall portion provided with an elongated, narrow, transparent window extending from a portion apart from the ink supply port 13 toward a position near to the ink supply port 13. Moreover, a part of the ink supply port 13 may be made transparent so that the amount of remaining ink inside the ink supply port 13 can be detected.

In each of the above embodiments, black ink containing 3.0% of a dye was used as ink 14. However, the dye content need not be restricted to 3.0%, and an ink of any solvent formulation can be used unless it contains a binder for firmly binding the dye to be used to the ink absorbing member 11.

Besides, the color of the ink was black in the respective embodiments, but inks of various colors can of course be used. In this case, it is only natural that a remaining ink amount detection characteristic comparable to that of the black ink can be used by attaching a color filter for the color of the ink to the sensor portion.

The print head in each of the embodiments is preferably one having an electro-thermal converter which generates thermal energy for causing film bolting to ink as an element for generating energy for use in ejecting ink.

Figure 8:
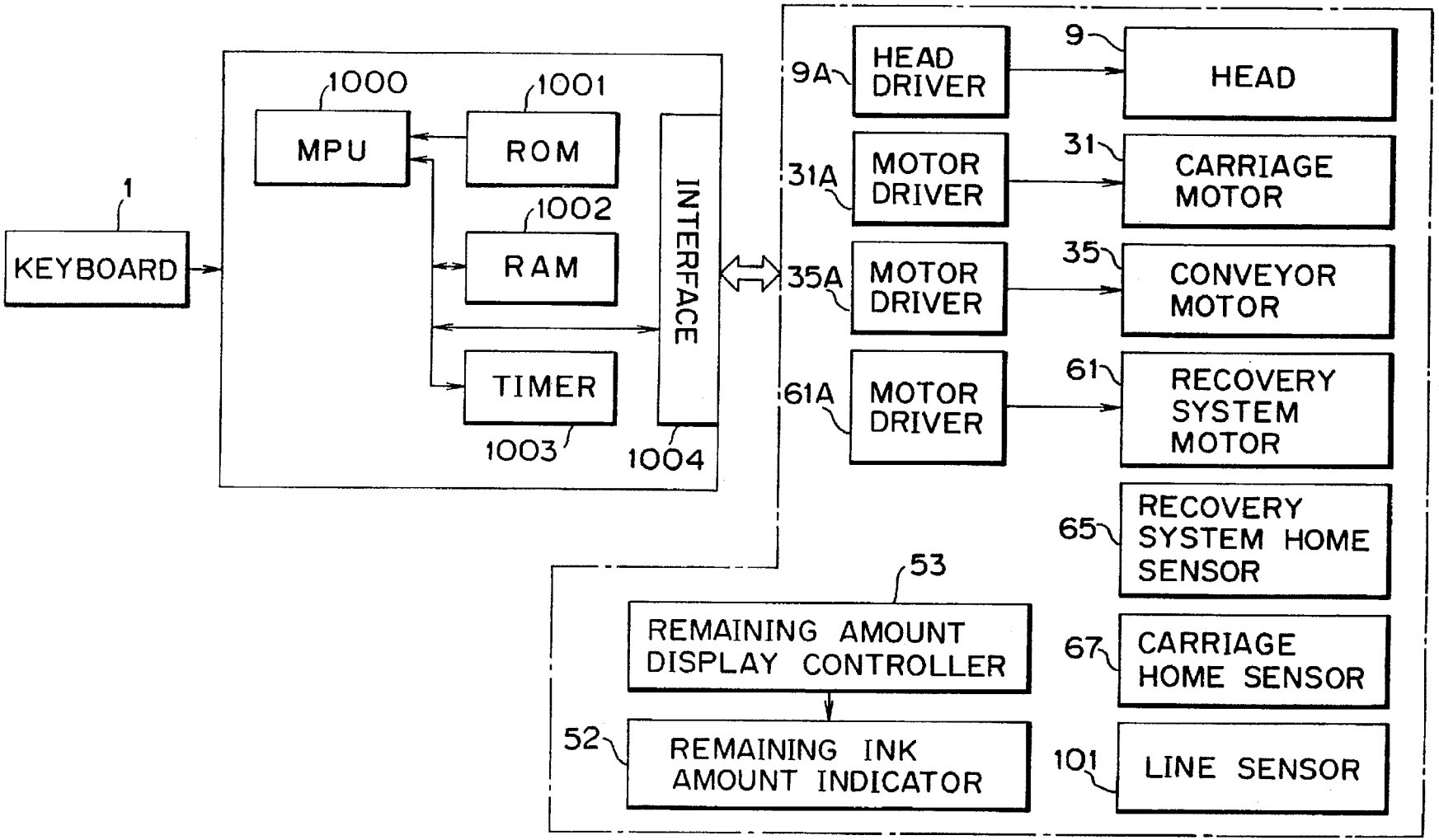
FIG. 8 is a block diagram showing another embodiment of the ink jet printing apparatus of the present invention.

FIG. 8 is a block diagram showing an embodiment of an ink jet printing apparatus according to the present invention. Detection of the amount of remaining ink, its display, and display control in the printing apparatus will be described with reference to FIG. 8. In this drawing, the reference numeral 1 denotes a keyboard; 1000, an MPU; 1001, a ROM; 1002, a RAM; 1003, a timer; and 1004, an interface. The numeral 9, denotes a head cartridge, 9A a head driver, 31 a carriage motor, 35 a conveyor motor, 61 a recovery system motor, 31A, 35A and 61A are each a motor driver, 65 a recovery system home sensor, and 67 a carriage home sensor. The numeral 53 denotes a remaining amount display controller. The MPU 1000 detects the level of ink within the ink tank based on a detection signal corresponding to that reflection density beyond the predetermined threshold which has been detected by the line sensor 101. Then, the MPU 1000 displays the amount of remaining ink on a remaining ink amount indicator 52 via the remaining amount display controller 53.

Figure 9:
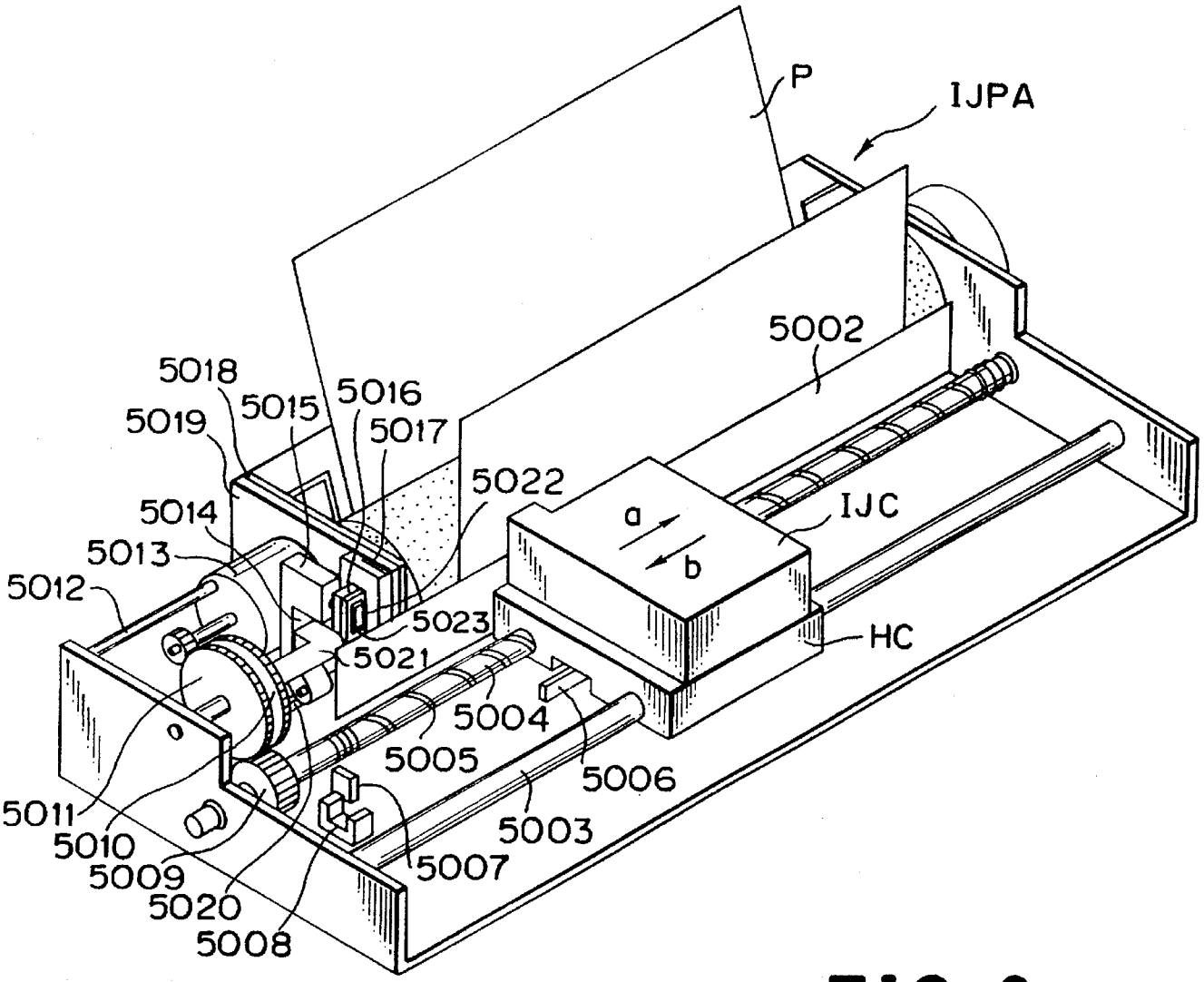
FIG. 9 is a schematic perspective view showing still another embodiment of the ink jet printing apparatus of the present invention.

FIG. 9 is a schematic view of an ink jet printing apparatus IJPA to which the present invention is applied. A carriage HC has a pin (not shown) which engages with a spiral groove 5004 of a lead screw 5005 rotating via driving force transmission gears 5011, 5009 in association with the normal or reverse rotation of a driving motor 5013, and makes a reciprocating movement in the direction of arrow a or b attendant on the rotation of the lead screw. To the carriage HC is mounted a head cartridge IJC. Illustrations of the constructions for this mounting and for electrical signal connection between the print head and the apparatus are omitted in FIG. 9. Details of such constructions are disclosed, for example, in Japanese Patent Application Laying-open No. 3-104677 belonging to the present applicant. The numeral 5002 denotes a press plate for a paper, a film for OHP, or any other printing medium (hereinafter referred to as paper). This plate 5002 presses a paper against a platen 5000 over the range of movement of the carriage. The numerals 5007, 5008 denote photocouplers which serve as home position detection means for confirming the presence of a carriage lever 5006 in this area and performing switchover of the direction of rotation of the motor 5013. The numeral 5016 denotes a member for supporting a cap member 5022 which covers the front face of the print head. The numeral 5015 is a suction means for sucking the inside of this cap, and carries out suction recovery of the print head via a cap opening 5023. The numeral 5017 is a cleaning blade, and the numeral 5019 is a member for making this blade movable back and forth. The blade 5017 and the member 5019 are supported by a body support plate 5018. The cleaning blade is not restricted to the form illustrated, but may be a well-known cleaning blade. The numeral 5012 is a lever for starting the suction of suction recovery. This lever moves in accordance with the movement of a cam 5020 engaging with the carriage, and a driving force from the driving motor is applied thereto or removed therefrom by a known transmission means, such as a clutch, to control its movement.

These capping, cleaning, suction recovery operations are designed such that when the carriage HC is positioned in the home position area, the desired operation is performed at any of their corresponding positions by the action of the lead screw 5005. Any of these operations is applicable to the instant embodiment, provided that the desired operation can be performed with a known timing.

As described above, the present invention involves a cartridge for ink jet in which the difference between the reflection density of the ink absorbing member before ink consumption and that after ink consumption is 0.1 or more in terms of absorbance (O.D.), and part or all of the ink tank housing is composed of a transparent member. Thus, the amount of ink remaining within the ink tank can be detected visually or by an optical means, so that a simple, inexpensive means of detecting the amount of remaining ink can be provided.

Furthermore, the use of a line sensor as a remaining ink amount detection means enables the amount of remaining ink to be detected and displayed as an analog pattern.

In addition, various modifications of the optical detection means would not increase the cost of the ink jet cartridge, a replaceable expendable article, since the ink tank itself need not have a special structure.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. An ink tank for a recording apparatus in which ink used for recording is accommodated, the ink tank comprising:

a main body accommodating the ink; and an ink absorbing member accommodated in said main body, wherein at least one part of said main body has a transparent portion permitting viewing of said ink absorbing member from an outside of said main body, said ink absorbing member has characteristics such that a difference between a reflection density of said ink absorbing member when said ink absorbing member retains the ink and a reflection density of said ink absorbing member after the ink is consumed is represented by an optical density of absorbance which is 0.1 or more, and said ink absorbing member is a porous material having three-dimensional network and is also a thermosetting foam based on a condensate of an amino-containing compound with formaldehyde.

2. An ink tank as claimed in claim 1, wherein said amino-containing compound is at least one compound selected from the group consisting of melamine, urea, carboxylic acid amides, dicyandiamide, guanidine, sulfuryl amide, sulfonic acid amides, aliphatic amines, and derivatives thereof.

3. An ink tank as claimed in claim 1, wherein said ink absorbing member is a porous ceramic material.

4. An ink tank as claimed in claim 1, wherein said ink absorbing member comprises metal fibers.

5. A head cartridge for a recording apparatus, the head cartridge comprising:

an ink tank in which ink used for recording is accommodated, said ink tank including a main body accommodating the ink and an ink absorbing member accommodated in said main body, wherein at least one part of said main body has a transparent portion permitting viewing of said ink absorbing member from an outside of said main body, said ink absorbing member has characteristics such that a difference between a reflection density of said ink absorbing member when said ink absorbing member retains the ink and a reflection density of said ink absorbing member after the ink is consumed is represented by an optical density of absorbance which is 0.1 or more, and said ink absorbing member is a porous material having a three-dimensional network and is also a thermosetting foam based on a condensate of an amino-containing compound with formaldehyde; and an ink head integrated with said ink tank and being attachable to and detachable from an ink jet printing apparatus, said ink head including ejecting means for ejecting ink to a printing medium.

6. A head cartridge as claimed in claim 5, wherein said ink tank and said ink head are separable from each other.

7. A head cartridge as claimed in claim 5, wherein said ink head has an electro-thermal converter, which generates thermal energy for causing film boiling to ink, as an element for generating energy for use in ejecting ink.

8. An ink jet printing apparatus in which recording is performed on a printing medium, the apparatus comprising:

an ink tank in which ink used for recording is accommodated, including a main body accommodating the ink and an ink absorbing member accommodated in said main body, wherein at least one part of said main body has a transparent portion permitting viewing of said ink absorbing member from an outside of said main body, said ink absorbing member has characteristics such that a difference between a reflection density of said ink absorbing member when said ink absorbing member retains the ink and a reflection density of said ink absorbing member after the ink is consumed is represented by an optical density of absorbance which is 0.1 or more, and said ink absorbing member is a porous material having a three-dimensional network and is also a thermosetting foam based on a condensate of an amino-containing compound with formaldehyde;

remaining ink amount detection means for detecting an amount of ink remaining within the ink absorbing member through the transparent portion of the housing of the ink tank; and information presenting means for presenting information corresponding to data on the amount of ink remaining provided by the remaining ink amount detection means.

9. An ink jet printing apparatus as claimed in claim 8, further comprising means for conveying the printing medium.

10. An ink jet printing apparatus in which recording is performed on a printing medium, the apparatus comprising:

a head cartridge, constructed of an ink tank in which ink used for recording is accommodated and an ink head integrated with said ink tank and being attachable to and detachable from the ink jet printing apparatus, said ink tank including a main body accommodating the ink and an ink absorbing member accommodated in said main body, wherein at least one part of said main body has a transparent portion permitting viewing of said ink absorbing member from an outside of said main body, said ink absorbing member has characteristics such that a difference between a reflection density of said ink absorbing member when said ink absorbing member retains the ink and a reflection density of said ink absorbing member after the ink is consumed is represented by an optical density of absorbance which is 0.1 or more, and said ink absorbing member is a porous material having a three-dimensional network and is also a thermosetting foam based on a condensate of an amino-containing compound with formaldehyde, and said ink head including ejecting means for ejecting ink to a printing medium;

remaining ink amount detection means for detecting an amount of ink remaining within the ink absorbing member through the transparent portion of the housing of the ink tank; and information presenting means for presenting information corresponding to data on the amount of remaining ink provided by the remaining ink amount detection means.

11. An ink jet printing apparatus as claimed in claim 10, further comprising means for conveying the printing medium.

12. An ink jet printing apparatus as claimed in claim 10, wherein said remaining ink amount detection means is optical means for measuring an absorbance of ink.

13. An ink jet printing apparatus as claimed in claim 10, wherein the transparent portion of said ink tank is formed along a direction which becomes the direction of gravity during use of the ink tank, and the remaining ink amount detection means is a line sensor which detects the amount of ink remaining within the ink absorbing member through all of the transparent portion of said ink tank.

14. An ink jet printing apparatus as claimed in claim 10, wherein said remaining ink amount detection means is a spot sensor which detects the amount of ink remaining within the ink absorbing member through part of the transparent portion of said ink tank.

15. An ink jet printing apparatus as claimed in claim 10, wherein at least part of an ink supply portion extending from said ink tank to said ink head is formed to be transparent and said remaining ink amount detection means is a spot sensor which detects the amount of ink remaining within the ink absorbing member through the transparent portion of said ink supply portion.

16. An ink jet printing apparatus as claimed in claim 13, wherein said remaining ink amount detection means detects the amount of remaining ink over time, and said information presentation means displays the amount of remaining ink in response to data on the amount of remaining ink detected over time by said optical remaining ink detection means.

17. An ink jet printing apparatus as claimed in claim 14, wherein said information presenting means displays an exhaustion of ink in response to data on the amount of remaining ink detected by said remaining ink amount detection means.

18. An ink jet printing apparatus as claimed in claim 10, wherein said remaining ink amount detection means is equipped with a color filter corresponding to a color of ink within said ink tank.

19. An ink jet printing apparatus in which recording is performed on a printing medium, the apparatus comprising:

an ink absorbing member holding ink, said ink absorbing member having characteristics such that a difference between a reflection density of said ink absorbing member when said ink absorbing member retains the ink and a reflection density of said ink absorbing member after the ink is consumed is represented by an optical density of absorbance which is 0.1 or more, wherein said ink absorbing member is a porous material having a three-dimensional network and is also a thermosetting foam based on a condensate of an amino-containing compound with formaldehyde;

remaining ink amount detection means for optically detecting over time an amount of ink remaining in the ink absorbing member and for providing data regarding the amount of remaining ink, and ink ejection control means for varying ink ejection conditions in response to changes in the characteristics of said ink absorbing member caused in accordance with data on the amount of remaining ink detected over time provided by said remaining ink amount detection means.

20. An ink jet printing apparatus as claimed in claim 19, further comprising means for conveying the printing medium.

21. An ink jet printing apparatus as claimed in claim 19, wherein the ink ejection conditions are head driving conditions such as voltage or pulse duration.

22. An ink jet printing apparatus as claimed in claim 19, wherein the ink ejection control means comprises an insulating heater.

23. An ink jet printing apparatus as claimed in claim 19, wherein the ink ejection conditions are varied by inclining the ink tank.

* * * * *

UNITED STATES PATENT AND TRADEMARK OFFICE

CERTIFICATE OF CORRECTION

PATENT NO. : 5,652,610

DATED : July 29, 1997

INVENTOR(S) : JUN KAWAI ET AL.

It is certified that error appears in the above-identified patent and that said Letters Patent is hereby corrected as shown below:

COLUMN 5

Line 26, "form" should read --from--.
Line 37, close up right margin.
Line 38, close up left margin.

COLUMN 6

Line 31, "chip JMC" should read --chip JHC--.

COLUMN 7

Line 7, "had" should read --head--.
Line 59, "Shown" should read --shown--.

COLUMN 8

Line 11, "the" should read --of the--.
Line 45, "user." should read --used.--.

COLUMN 9

Line 8, "foam" should read --foam is--.
Line 40, "ening" should read --en--.
Line 42, "Such," should read --Such--.
Line 46, "another" should read --other--.
Line 48, "another" should read --the other--.
Line 55, "support:" should read --support--.

UNITED STATES PATENT AND TRADEMARK OFFICE

CERTIFICATE OF CORRECTION

PATENT NO. : 5,652,610

DATED : July 29, 1997

INVENTOR(S) : JUN KAWAI ET AL.

It is certified that error appears in the above-identified patent and that said Letters Patent is hereby corrected as shown below:

COLUMN 12

Line 21, "having" should read --having a--.

Signed and Sealed this

Third Day of March, 1998

*Attest:*

*Attesting Officer*

BRUCE LEHMAN

*Commissioner of Patents and Trademarks*